US010782719B2

(12) United States Patent
Kim et al.

(10) Patent No.: US 10,782,719 B2
(45) Date of Patent: Sep. 22, 2020

(54) CAPACITOR-LESS VOLTAGE REGULATOR, SEMICONDUCTOR DEVICE INCLUDING THE SAME AND METHOD OF GENERATING POWER SUPPLY VOLTAGE

(71) Applicant: Samsung Electronics Co., Ltd., Suwon-si, Gyeonggi-do (KR)

(72) Inventors: June-Soo Kim, Daegu (KR); Kyeong-Do Kim, Seoul (KR); Eun-Jin Kim, Hwaseong-si (KR); Sang-Hyo Lee, Incheon (KR); Seung-Won Lee, Yongin-si (KR)

(73) Assignee: SAMSUNG ELECTRONICS CO., LTD., Gyeonggi-Do (KR)

( * ) Notice: Subject to any disclaimer, the term of this patent is extended or adjusted under 35 U.S.C. 154(b) by 0 days.

(21) Appl. No.: 16/123,194

(22) Filed: Sep. 6, 2018

(65) Prior Publication Data

US 2019/0163219 A1 May 30, 2019

(30) Foreign Application Priority Data

Nov. 28, 2017 (KR) ..... 10-2017-0160987

(51) Int. Cl.
*G05F 1/575* (2006.01)
*G05F 1/46* (2006.01)
(Continued)

(52) U.S. Cl.
CPC ..... *G05F 1/575* (2013.01); *G05F 1/462* (2013.01); *G05F 1/468* (2013.01); *G05F 1/613* (2013.01); *G05F 1/618* (2013.01)

(58) Field of Classification Search
CPC ..... G05F 1/575; G05F 1/462; G05F 1/468; G05F 1/613; G05F 1/618
See application file for complete search history.

(56) References Cited

U.S. PATENT DOCUMENTS 5,987,615 A 11/1999 Danstrom
7,495,422 B2 2/2009 Mok et al.
(Continued)

FOREIGN PATENT DOCUMENTS

DE 102005029110 12/2006
DE 102011051033 12/2011
(Continued)

OTHER PUBLICATIONS

Office Action for corresponding German Patent Application No. 10 2018 120 444.2 dated Jul. 21, 2020 and English translation thereof.

*Primary Examiner* — Adolf D Berhane
*Assistant Examiner* — Kevin H Sprenger
(74) *Attorney, Agent, or Firm* — Harness, Dickey & Pierce, P.L.C.

(57) ABSTRACT

A voltage regulator includes a voltage converter is configured to generate an output power supply voltage based on an input power supply voltage and an input reference voltage and provide the output power supply voltage to an external functional circuit, the voltage converter including an output terminal configured to output the output power supply voltage; and a sinker connected to the output terminal, the sinker configured to generate a sink current in response to a sink enable signal while the external functional circuit is not driven and configured to block generation of the sink current in response to an operating enable signal while the external functional circuit is driven, wherein the sink current corresponds to a load current that is to be consumed while the external functional circuit is driven.

20 Claims, 12 Drawing Sheets

(51) Int. Cl.
*G05F 1/613* (2006.01)
*G05F 1/618* (2006.01)

(56) References Cited

U.S. PATENT DOCUMENTS 7,603,572 B2 10/2009 Berthold et al.
8,648,578 B2 2/2014 Zhao et al.
8,872,492 B2 * 10/2014 Zhang ..... G05F 1/575 323/280
8,943,333 B2 1/2015 Kawasaki
9,229,462 B2 1/2016 Shukla et al.
9,577,613 B2 2/2017 Yang et al.
10,171,065 B2 * 1/2019 Raychaudhuri ..... H03K 3/011
2007/0091036 A1 * 4/2007 Han ..... G09G 3/342 345/82
2009/0027021 A1 * 1/2009 Dequina ..... H02M 1/38 323/282
2013/0082672 A1 4/2013 Kim et al.
2013/0141063 A1 * 6/2013 Kay ..... G05F 1/468 323/271
2014/0266103 A1 9/2014 Wang et al.
2015/0231408 A1 * 8/2015 Williams ..... A61N 5/06 607/88
2015/0326120 A1 * 11/2015 Kelin ..... H02M 3/158 323/282
2016/0124448 A1 5/2016 Murukumpet et al.
2017/0090501 A1 * 3/2017 Fletcher ..... G05F 3/08

FOREIGN PATENT DOCUMENTS

KR 20000032092 A 6/2000
KR 101551643 B1 9/2015
WO WO-02093340 A1 11/2002

* cited by examiner

CAPACITOR-LESS VOLTAGE REGULATOR, SEMICONDUCTOR DEVICE INCLUDING THE SAME AND METHOD OF GENERATING POWER SUPPLY VOLTAGE

CROSS-REFERENCE TO RELATED APPLICATION

This application claims priority under 35 USC § 119 to Korean Patent Application No. 10-2017-0160987, filed on Nov. 28, 2017 in the Korean Intellectual Property Office (KIPO), the contents of which are herein incorporated by reference in their entirety.

BACKGROUND

1. Technical Field

Example embodiments relate generally to semiconductor devices, and more particularly to voltage regulators that generate power supply voltages provided to semiconductor integrated circuits and operate without external capacitors, semiconductor devices including the voltage regulators, and methods of generating power supply voltages.

2. Description of the Related Art

Typically, a semiconductor device includes a semiconductor integrated circuit performing a particular function and a power supply circuit for powering the semiconductor integrated circuit. For example, a semiconductor memory device may include a memory cell array storing data and a voltage regulator supplying an operating voltage to the memory cell array. The voltage regulator has been driven with an external capacitor or an output capacitor that is connected to an output terminal of the voltage regulator and has a relatively large capacitance. Even if a load current flowing through a load is suddenly changed, a power supply voltage output from the voltage regulator may not be drastically changed due to the external capacitor, and the voltage regulator may stably provide the power supply voltage. However, the voltage regulator has occupied a significant amount of space in the semiconductor device due to the external capacitor. To reduce a size of a semiconductor device, researchers are conducting various research projects on techniques of a capacitor-less (or capless) voltage regulator that operates without an external capacitor.

SUMMARY

A voltage regulator includes a voltage converter configured to generate an output power supply voltage based on an input power supply voltage and an input reference voltage and provide the output power supply voltage to an external functional circuit, the voltage converter including an output terminal configured to output the output power supply voltage; and a sinker connected to the output terminal, the sinker configured to generate a sink current in response to a sink enable signal while the external functional circuit is not driven and configured to block generation of the sink current in response to an operating enable signal while the external functional circuit is driven, wherein the sink current corresponds to a load current that is to be consumed while the external functional circuit is driven.

A semiconductor device includes a functional circuit configured to operate based on an output power supply voltage; a voltage regulator configured to, generate the output power supply voltage based on an input power supply voltage and an input reference voltage, generate a sink current in response to a sink enable signal while the functional circuit is not driven, and block generation of the sink current in response to an operating enable signal while the functional circuit is driven; and a controller configured to control the functional circuit and the voltage regulator, wherein the sink current corresponds to a load current that is to be consumed while the functional circuit is driven.

A method of generating a power supply voltage includes generating an output power supply voltage based on an input power supply voltage and an input reference voltage and providing the output power supply voltage to an external functional circuit; generating a sink current in response to a sink enable signal while the external functional circuit is not driven; and blocking generation of the sink current in response to an operating enable signal while the external functional circuit is driven, wherein the sink current corresponds to a load current that is to be consumed while the external functional circuit is driven.

BRIEF DESCRIPTION OF THE DRAWINGS

The above and other features and advantages of example embodiments of the inventive concepts will become more apparent by describing in detail example embodiments of the inventive concepts with reference to the attached drawings. The accompanying drawings are intended to depict example embodiments of the inventive concepts and should not be interpreted to limit the intended scope of the claims. The accompanying drawings are not to be considered as drawn to scale unless explicitly noted.

DETAILED DESCRIPTION OF THE EMBODIMENTS

Figure 1:
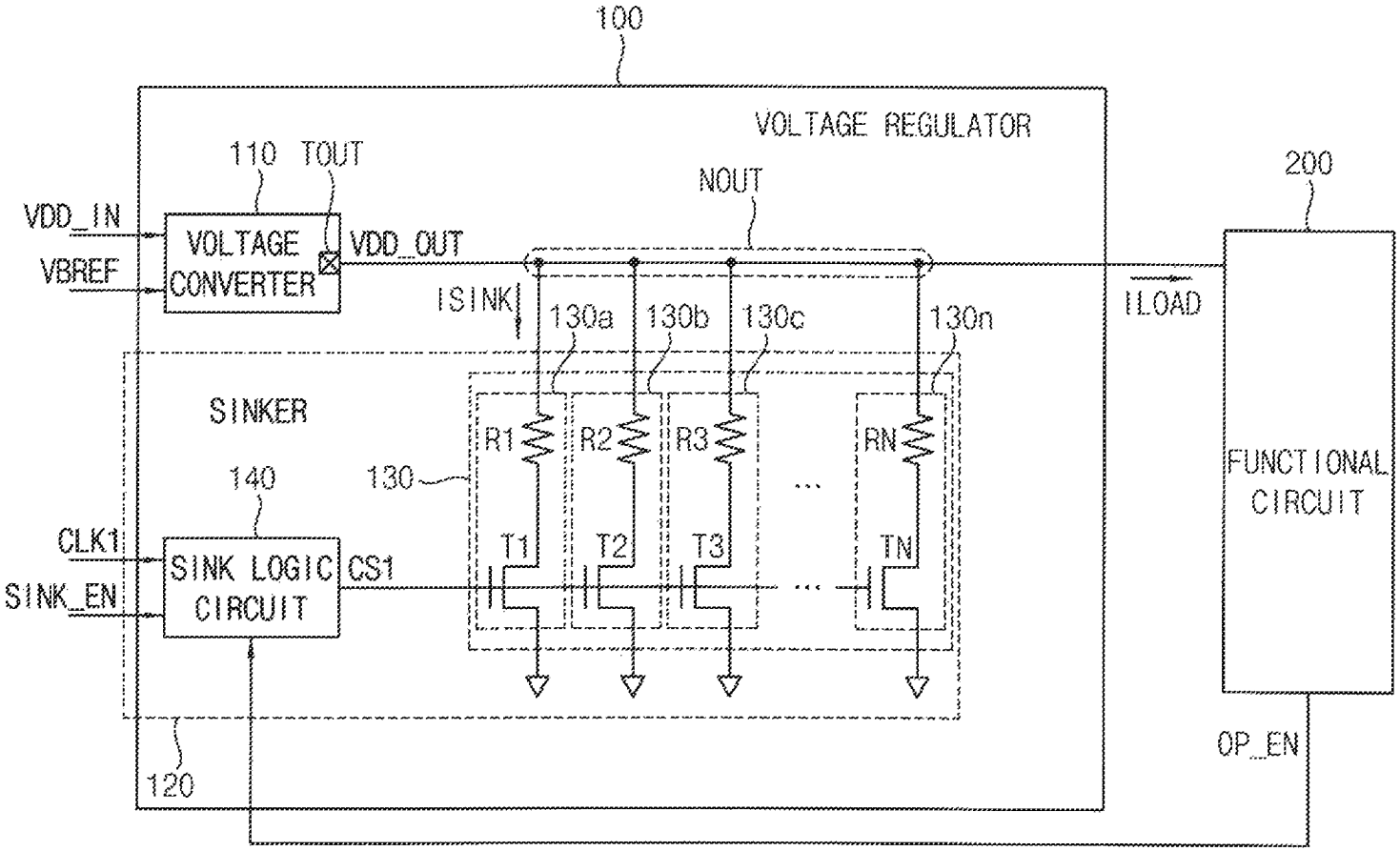
FIG. 1 is a block diagram illustrating a voltage regulator according to at least some example embodiments of the inventive concepts.

As is traditional in the field of the inventive concepts, embodiments are described, and illustrated in the drawings, in terms of functional blocks, units and/or modules. Those skilled in the art will appreciate that these blocks, units and/or modules are physically implemented by electronic (or optical) circuits such as logic circuits, discrete components, microprocessors, hard-wired circuits, memory elements, wiring connections, and the like, which may be formed using semiconductor-based fabrication techniques or other manufacturing technologies. In the case of the blocks, units and/or modules being implemented by microprocessors or similar, they may be programmed using software (e.g., microcode) to perform various functions discussed herein and may optionally be driven by firmware and/or software. Alternatively, each block, unit and/or module may be implemented by dedicated hardware, or as a combination of dedicated hardware to perform some functions and a processor (e.g., one or more programmed microprocessors and associated circuitry) to perform other functions. Also, each block, unit and/or module of the embodiments may be physically separated into two or more interacting and discrete blocks, units and/or modules without departing from the scope of the inventive concepts. Further, the blocks, units and/or modules of the embodiments may be physically combined into more complex blocks, units and/or modules without departing from the scope of the inventive concepts.

FIG. 1 is a block diagram illustrating a voltage regulator according to at least some example embodiments of the inventive concepts.

Referring to FIG. 1, a voltage regulator 100 includes a voltage converter 110 and a sinker 120.

The voltage converter 110 generates an output power supply voltage VDD_OUT based on an input power supply voltage VDD_IN and an input reference voltage VBREF. The voltage converter 110 includes an output terminal TOUT outputting the output power supply voltage VDD_OUT. The voltage converter 110 may have a configuration of generating a stable power supply voltage (e.g., stably generating the output power supply voltage VDD_OUT). A detailed configuration of the voltage converter 110 will be described with reference to FIG. 3.

The output power supply voltage VDD_OUT is provided to an external functional circuit 200 that is disposed or located outside the voltage regulator 100. In other words, the functional circuit 200 may operate or may be driven based on the output power supply voltage VDD_OUT. Although not illustrated in FIG. 1, a driving clock signal may be additionally provided to the functional circuit 200, and the functional circuit 200 may operate or may be driven based on the driving clock signal. In addition, while the functional circuit 200 operates or is driven based on the output power supply voltage VDD_OUT and/or the driving clock signal, a load current ILOAD may be consumed.

In some example embodiments, the functional circuit 200 may be any semiconductor integrated circuit performing specific or, alternatively, predetermined functions. For example, the functional circuit 200 may include a data storage circuit including, e.g., a memory cell array, a display control circuit, any signal processing circuit such as an image signal processing circuit, or the like.

The sinker 120 is connected to the output terminal TOUT via an output node NOUT. The sinker 120 generates a sink current ISINK in response to a sink enable signal SINK_EN while the functional circuit 200 is not driven. The sink current ISINK corresponds to the load current ILOAD that is to be consumed while the functional circuit 200 is driven. The sinker 120 blocks generation of the sink current ISINK in response to an operating enable signal OP_EN while the functional circuit 200 is driven. In other words, the sinker 120 and the functional circuit 200 may be complementarily enabled. While the functional circuit 200 is disabled (e.g., is not driven), the sinker 120 may be enabled to generate the sink current ISINK. While the functional circuit 200 is enabled (e.g., is driven), the sinker 120 may be disabled and may not generate the sink current ISINK.

According to at least some example embodiments of the inventive concepts, the amount of the load current ILOAD may be predetermined. For example, the amount of the load current ILOAD may be determined before the functional circuit 200 is manufactured in mass production (e.g., at a time point at which the functional circuit 200 is designed or experiment samples of the functional circuit 200 are manufactured). The voltage regulator 100 including the sinker 120 may be manufactured such that the sink current ISINK corresponding to the load current ILOAD is generated based on the predetermined amount of the load current ILOAD In some example embodiments, the sinker 120 may include a current generator 130 and a sink logic circuit 140.

The current generator 130 may be connected to the output terminal TOUT via the output node NOUT. The current generator 130 may generate the sink current ISINK in response to a first control signal CS1. The current generator 130 may include a plurality of current level controllers 130*a*, 130*b*, 130*c*, . . . , 130*n*. The plurality of current level controllers 130*a*, 130*b*, 130*c*, . . . , 130*n* may be connected in parallel between the output terminal TOUT (e.g., the output node NOUT) and a ground voltage. The plurality of current level controllers 130*a*, 130*b*, 130*c*, . . . , 130*n* may be selectively turned on in response to the first control signal CS1. In FIG. 1 and following drawings, an inverted triangle (e.g., V) connected to one electrode of a transistor or one end of a resistor may represent the ground voltage (e.g., GND or VSS voltage).

Each of the plurality of current level controllers 130*a*, 130*b*, 130*c*, . . . , 130*n* may include a respective one of a plurality of resistors R1, R2, R3, . . . , RN and a respective one of a plurality of transistors T1, T2, T3, . . . , TN. For example, the first current level controller 130*a* may include the first resistor R1 and the first transistor T1, the second current level controller 130*b* may include the second resistor R2 and the second transistor T2, the third current level controller 130*c* may include the third resistor R3 and the third transistor T3, and the N-th current level controller 130*n* may include the N-th resistor RN and the N-th transistor TN, where N is a natural number. Each of the plurality of resistors R1, R2, R3, . . . , RN may be connected to the output terminal TOUT via the output node NOUT. Each of the plurality of transistors T1, T2, T3, . . . , TN may be connected between a respective one of the plurality of resistors R1, R2, R3, . . . , RN and the ground voltage. Each of the plurality of transistors T1, T2, T3, . . . , TN may have a control electrode receiving the first control signal CS1.

The sink logic circuit 140 may generate the first control signal CS1 based on a first clock signal CLK1, the sink enable signal SINK_EN and the operating enable signal OP_EN. For example, the operating enable signal OP_EN may be provided from the functional circuit 200. A detailed configuration of the sink logic circuit 140 will be described with reference to FIG. 4.

In some example embodiments, the first control signal CS1 may be an N-bit control signal. For example, first through N-th bits of the first control signal CS1 may be applied to the control electrodes of the plurality of transistors T1, T2, T3, . . . , TN, respectively. For example, the N bits of the N-bit control signal CS1 may be provided to the current generator 130 via N signal lines connected between the sink logic circuit 140 and the N transistors T1-TN, respectively, such that the N bits of the N-bit control signal CS1 can be used to control the current level controllers 130*a*, 130*b*, 130*c*, . . . , 130*n* independently. The number of turned-on current level controllers among the plurality of current level controllers 130*a*, 130*b*, 130*c*, . . . , 130*n* (e.g., the number of turned-on transistors among the plurality of transistors T1, T2, T3, . . . , TN) may be adjusted or controlled based on the first control signal CS1, and thus the amount of the sink current ISINK may be adjusted or controlled. For example, the amount of the sink current ISINK may increase (or decrease) as the number of turned-on current level controllers increases (or decreases).

In some example embodiments, resistances of the plurality of resistors R1, R2, R3, . . . , RN may be substantially the same as or different from each other.

Figure 2:
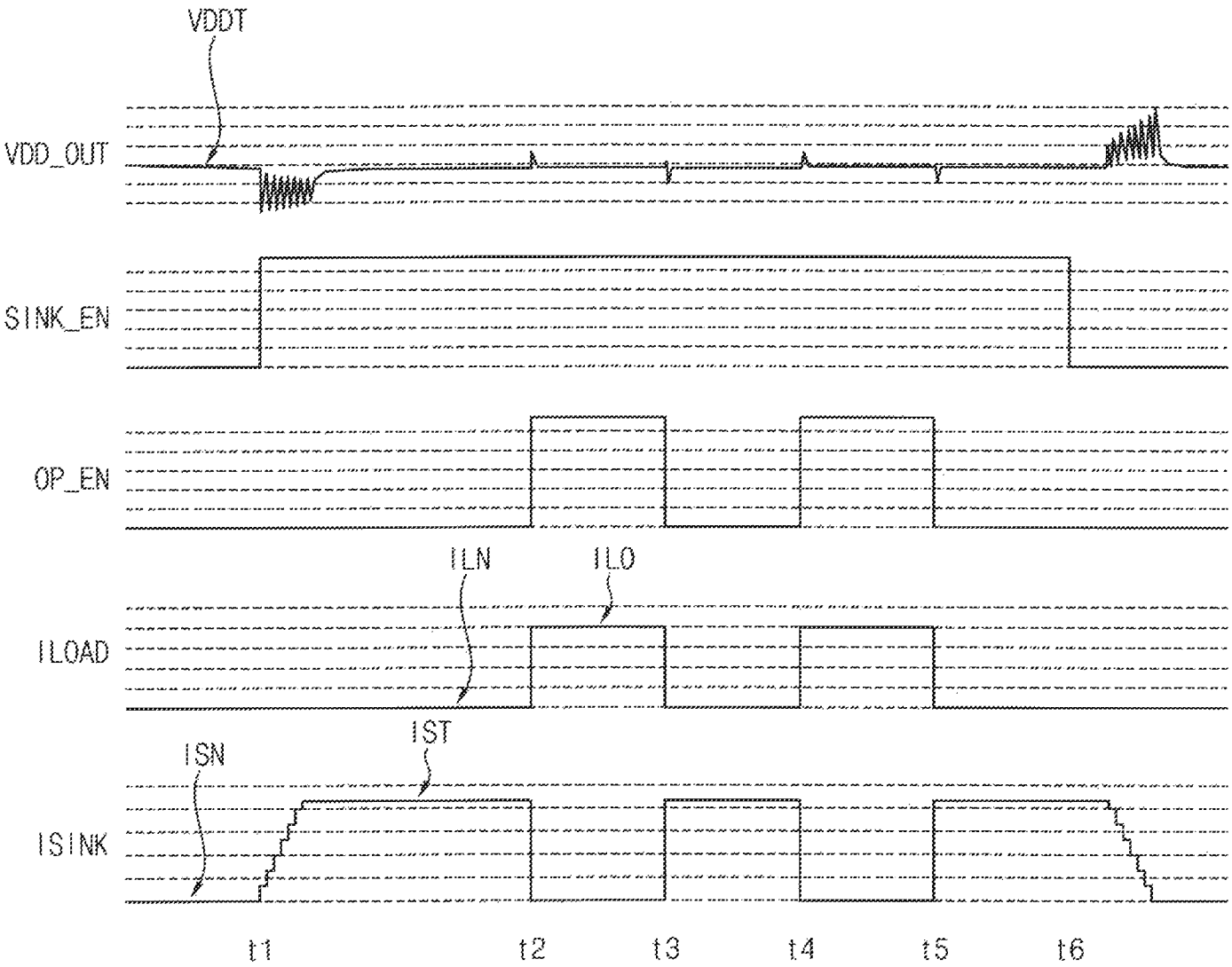
FIG. 2 is a timing diagram for describing an operation of a voltage regulator according to at least some example embodiments of the inventive concepts.

FIG. 2 is a timing diagram for describing an operation of a voltage regulator according to at least some example embodiments of the inventive concepts.

Referring to FIGS. 1 and 2, before time t1, the voltage converter 110 generates the output power supply voltage VDD_OUT having a target power level VDDT.

At time t1, the sink enable signal SINK_EN is activated by transitioning from a logic low level to a logic high level, and the sinker 120 is enabled. When the functional circuit 200 is to be driven or used, the sinker 120 is enabled to generate the sink current ISINK before the functional circuit 200 is enabled to perform specific or, alternatively, predetermined functions.

A level of the sink current ISINK scalariformly (e.g., gradationally, gradually, stage by stage or in stages) increases from a zero level ISN to a target level IST in response to an activation of the sink enable signal SINK_EN (e.g., in response to a rising edge of the sink enable signal SINK_EN). In this case, a level change or variation of the output power supply voltage VDD_OUT may be reduced or minimized by scalariformly increasing the level of the sink current ISINK.

The zero level ISN may represent non-generation of the sink current ISINK, and the target level IST may correspond to the load current ILOAD. For example, the zero level ISN may be about 0 mA, and the target level IST may correspond to an operating level ILO that is a level of the load current ILOAD while the functional circuit 200 actually operates or is driven.

Since the functional circuit 200 does not actually operate or is not actually driven at time t1, the operating enable signal OP_EN is deactivated to maintain a logic low level, and the load current ILOAD has a non-operating level ILN. In other words, the non-operating level ILN represents that the functional circuit 200 does not actually operate or is not actually driven. Unlike the zero level ISN, the non-operating level ILN may not be about 0 mA because a leakage current is generated by the functional circuit 200 even if the functional circuit 200 does not actually operate or is not actually driven.

At time t2, the functional circuit 200 is enabled and actually operates or is actually driven based on the output power supply voltage VDD_OUT, the operating enable signal OP_EN is activated by transitioning from a logic low level to a logic high level, and a level of the load current ILOAD instantaneously (e.g., immediately, instantly or in a moment) increases from the non-operating level ILN to the operating level ILO. The level of the sink current ISINK instantaneously decreases from the target level IST to the zero level ISN in response to an activation of the operating enable signal OP_EN (e.g., in response to a rising edge of the operating enable signal OP_EN). In other words, as the functional circuit 200 actually begins to operate or be driven at time t2, the load current ILOAD is drastically or suddenly changed (e.g., increases), and at the same time, the sink current ISINK is also drastically or suddenly changed (e.g., decreases). In addition, a level of the output power supply voltage VDD_OUT may be slightly changed or fluctuated according to the level change of the load current ILOAD and the sink current ISINK.

In some example embodiments, the amount of the sink current ISINK may be substantially the same as the amount of the load current ILOAD. For example, the changed amount of the sink current ISINK and the changed amount of the load current ILOAD according to the enablement of the functional circuit 200 may be substantially the same as each other. For example, a difference between the target level IST and the zero level ISN of the sink current ISINK may be substantially the same as a difference between the operating level ILO and the non-operating level ILN of the load current ILOAD. In other words, an increment of the load current ILOAD and a decrement of the sink current ISINK may be substantially the same as each other, and thus the amount of total current flowing through the output terminal TOUT or the output node NOUT may not be substantially changed and may be substantially maintained.

In other example embodiments, the amount of the sink current ISINK may be proportional to the amount of the load current ILOAD.

At time t3, the functional circuit 200 is disabled and does not operate or is not driven, the operating enable signal OP_EN is deactivated by transitioning from the logic high level to the logic low level, and the level of the load current ILOAD instantaneously decreases from the operating level ILO to the non-operating level ILN. The level of the sink current ISINK instantaneously increases from the zero level ISN to the target level IST in response to a deactivation of the operating enable signal OP_EN (e.g., in response to a falling edge of the operating enable signal OP_EN). In other words, as the functional circuit 200 stops operating or being driven at time t3, the load current ILOAD is drastically or suddenly changed (e.g., decreases), and at the same time, the sink current ISINK is also drastically or suddenly changed (e.g., increases). In addition, the level of the output power supply voltage VDD_OUT may be slightly changed or fluctuated according to the level change of the load current ILOAD and the sink current ISINK.

An operation at time t4 and an operation at time t5 may be substantially the same as the operation at time t2 and the operation at time t3, respectively.

At time t6, the sink enable signal SINK_EN is deactivated by transitioning from the logic high level to the logic low level, and the sinker 120 is disabled. When it does not need to operate or be driven the functional circuit 200 anymore, the sinker 120 is disabled after the functional circuit 200 is disabled.

The level of the sink current ISINK scalariformly decreases from the target level IST to the zero level ISN in response to a deactivation of the sink enable signal SINK_EN (e.g., in response to a falling edge of the sink enable signal SINK_EN). In this case, a level change or variation of the output power supply voltage VDD_OUT may be reduced or minimized by scalariformly decreasing the level of the sink current ISINK.

Figure 11:
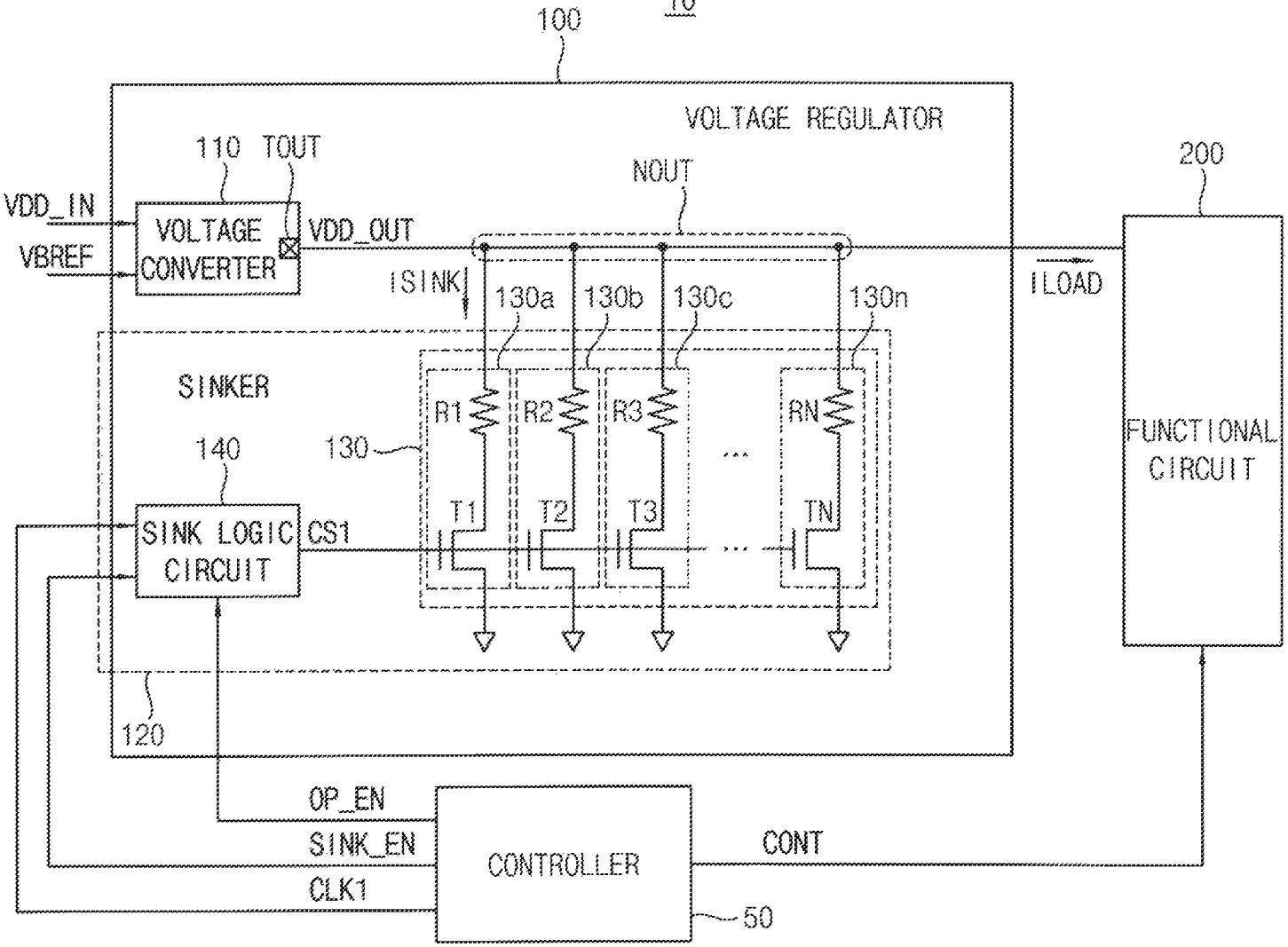
FIG. 11 is a block diagram illustrating a semiconductor device according to at least some example embodiments of the inventive concepts.

In some example embodiments, an operation of determining whether the functional circuit 200 is to be driven and/or whether it does not need to be driven the functional circuit 200 anymore, e.g., an operation of determining the activation/deactivation of the sink enable signal SINK_EN may be performed by an external controller (e.g., a controller 50 in FIG. 11).

The voltage regulator 100 according to at least some example embodiments of the inventive concepts may be implemented as a capacitor-less or a capless voltage regulator in which an external capacitor or an output capacitor connected to the output terminal TOUT or the output node NOUT is not used, and may include the sinker 120 for stabilizing the output power supply voltage VDD_OUT. The sinker 120 may be enabled in advance before the functional circuit 200 actually operates or is driven, and may scalariformly generate the sink current ISINK corresponding to the load current ILOAD that is predicted to be consumed while the functional circuit 200 is actually driven. When the functional circuit 200 is enabled and actually operates or is driven, and when the load current ILOAD is actually consumed by the functional circuit 200, the sinker 120 may block the generation of the sink current ISINK. Accordingly, the amount of total current flowing through the output terminal TOUT or the output node NOUT may not be substantially changed and may be substantially maintained, the level change of the output power supply voltage VDD_OUT may be minimized or reduced, and the output power supply voltage VDD_OUT having a relatively stable level may be generated.

Figure 3:
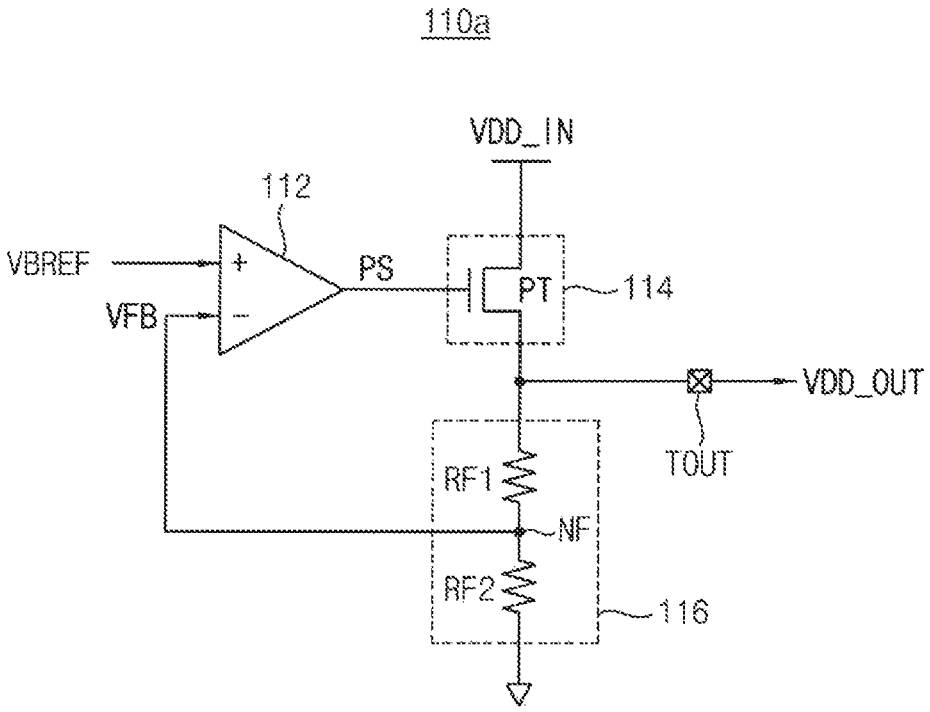
FIG. 3 is a circuit diagram illustrating an example of a voltage converter that is included in a voltage regulator according to at least some example embodiments of the inventive concepts.

FIG. 3 is a circuit diagram illustrating an example of a voltage converter that is included in a voltage regulator according to at least some example embodiments of the inventive concepts.

Referring to FIG. 3, a voltage converter 110*a* may include an error amplifier 112, a pass circuit 114, a feedback circuit 116 and the output terminal TOUT.

In some example embodiments, the voltage converter 110*a* may be implemented as a linear regulator. The linear regulator has a linear relationship between an input voltage and an output voltage. Unlike a switching regulator, an output voltage of the linear regulator is controlled without switching operations. The linear regulator may have relatively simple structure and reduced noise. For example, the voltage converter 110*a* may be a low dropout (LDO) regulator.

The error amplifier 112 may compare the input reference voltage VBREF with a feedback voltage VFB to generate a pass control signal PS. The error amplifier 112 may include a first input terminal receiving the input reference voltage VBREF, a second input terminal connected to a feedback node NF and receiving the feedback voltage VFB, and an output terminal outputting the pass control signal PS.

In some example embodiments, the input reference voltage VBREF may be provided from an outside of the voltage regulator (e.g., from an external reference voltage generator). In other example embodiments, although not illustrated in FIGS. 1 and 3, the voltage converter 110*a* or the voltage regulator (e.g., the voltage regulator 100 of FIG. 1) may include a reference voltage generator that generates the input reference voltage VBREF. For example, the input reference voltage VBREF may be a bandgap reference voltage.

The pass circuit 114 may generate the output power supply voltage VDD_OUT in response to the input power supply voltage VDD_IN and the pass control signal PS. The pass circuit 114 may include a pass transistor PT. The pass transistor PT may include a first electrode receiving the input power supply voltage VDD_IN, a control electrode receiving the pass control signal PS, and a second electrode connected to the output terminal TOUT and outputting the output power supply voltage VDD_OUT.

The feedback circuit 116 may generate the feedback voltage VFB based on the output power supply voltage VDD_OUT (e.g., by retrieving the output power supply voltage VDD_OUT from the output terminal TOUT). The feedback circuit 116 may include a plurality of resistors RF1 and RF2. The resistor RF1 may be connected between the output terminal TOUT and the feedback node NF, and the resistor RF2 may be connected between the feedback node NF and the ground voltage.

In the voltage regulator 100 according to at least some example embodiments of the inventive concepts, the output terminal TOUT of the voltage converter 110*a* may not be connected to an external capacitor having a relatively large capacitance (e.g., more than about 2 uF), and there may be only a parasitic capacitance (e.g., less than about 5 nF) at the output terminal TOUT that is caused by other elements (e.g., the pass transistor PT and/or the resistors RF1 and RF2). When the output power supply voltage VDD_OUT is generated only using the voltage converter 110*a*, the output power supply voltage VDD_OUT may be drastically or suddenly changed as the load current ILOAD is drastically or suddenly changed. For example, a functional circuit (e.g., the functional circuit 200 in FIG. 1) may be damaged or broken when the level of the output power supply voltage VDD_OUT becomes excessively high, and a malfunction of the functional circuit may be caused when the level of the output power supply voltage VDD_OUT becomes too low. As described with reference to FIGS. 1 and 2, when the output power supply voltage VDD_OUT is generated using the voltage converter 110*a* with the sinker 120 connected to the output terminal TOUT, the level change of the output power supply voltage VDD_OUT may be minimized or reduced, and the output power supply voltage VDD_OUT having a relatively stable level may be generated.

Although not illustrated in FIG. 3, the voltage converter included in the voltage regulator 100 according to at least some example embodiments of the inventive concepts may be implemented as any linear regulator, such as a shunt regulator, a series regulator, or the like.

Figure 4:
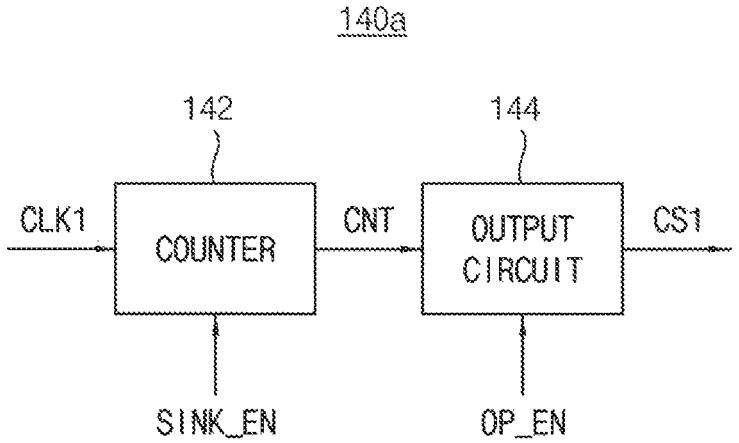
FIG. 4 is a block diagram illustrating an example of a sink logic circuit that is included in the voltage regulator of FIG. 1.

FIG. 4 is a block diagram illustrating an example of a sink logic circuit that is included in the voltage regulator of FIG. 1.

Referring to FIG. 4, a sink logic circuit 140*a* may include a counter 142 and an output circuit 144.

The counter 142 may generate a count signal CNT based on the first clock signal CLK1 and the sink enable signal SINK_EN. A value of the count signal CNT may be sequentially increases or decreases.

In some example embodiments, the counter 142 may sequentially increase a value of the count signal CNT from a minimum value (e.g., zero) to a maximum value in response to the first clock signal CLK1 and the activation of the sink enable signal SINK_EN (e.g., at time t1 in FIG. 2). After the value of the count signal CNT increases to reach the maximum value, the counter 142 may maintain the value of the count signal CNT to the maximum value while the activation of the sink enable signal SINK_EN is maintained.

In some example embodiments, the counter 142 may sequentially decrease the value of the count signal CNT from the maximum value to the minimum value in response to the first clock signal CLK1 and the deactivation of the sink enable signal SINK_EN (e.g., at time t6 in FIG. 2).

In some example embodiments, the first clock signal CLK1 may be provided from an outside of the voltage regulator (e.g., from an external oscillator). In other example embodiments, although not illustrated in FIGS. 1 and 4, the sink logic circuit 140*a* or the voltage regulator (e.g., the voltage regulator 100 of FIG. 1) may include an oscillator that generates the first clock signal CLK1.

The output circuit 144 may generate the first control signal CS1 based on the count signal CNT and the operating enable signal OP_EN.

In some example embodiments, the output circuit 144 may generate the first control signal CS1 in response to the count signal CNT such that at least a part of the plurality of current level controllers is turned on (e.g., the plurality of current level controllers 130*a*, 130*b*, 130*c*, . . . , 130*n* in FIG. 1 are selectively turned on) based on the first control signal CS1. For example, as described with reference to FIG. 1, the first control signal CS1 may be an N-bit control signal. The output circuit 144 may control or adjust bits of the first control signal CS1 in response to the count signal CNT such that the number of turned-on current level controllers corresponds to the value of the count signal CNT. For example, when the value of the count signal CNT is the minimum value (e.g., zero), the output circuit 144 may set the bits of the first control signal CS1 such that all of the current level controllers are turned off based on the first control signal CS1. When the value of the count signal CNT is "1," the output circuit 144 may set the bits of the first control signal CS1 such that only one current level controller is turned on based on the first control signal CS1. When the value of the count signal CNT is "2," the output circuit 144 may set the bits of the first control signal CS1 such that only two current level controllers are turned on based on the first control signal CS1. When the value of the count signal CNT is the maximum value (e.g., "N"), the output circuit 144 may set the bits of the first control signal CS1 such that all of the current level controllers are turned on based on the first control signal CS1. For example, if each of the transistors T1, T2, T3, . . . , TN included in the current level controllers 130*a*, 130*b*, 130*c*, . . . , 130*n* is a n-type metal oxide semiconductor (NMOS) transistor, and if the value of the count signal CNT is the maximum value, all of the bits of the first control signal CS1 may be set to have "1" (e.g., a logic high level).

In some example embodiments, the output circuit 144 may generate the first control signal CS1 in response to the activation of the operating enable signal OP_EN such that all of the plurality of current level controllers are turned off based on the first control signal CS1. For example, as described with reference to FIG. 1, the first control signal CS1 may be an N-bit control signal. When the operating enable signal OP_EN is activated (e.g., at time t2 in FIG. 2), the output circuit 144 may set the bits of the first control signal CS1 such that all of the current level controllers are turned off based on the first control signal CS1 (e.g., the generation of the sink current ISINK is blocked), even if the value of the count signal CNT is not the minimum value. For example, if each of the transistors T1, T2, T3, . . . , TN included in the current level controllers 130*a*, 130*b*, 130*c*, . . . , 130*n* is a NMOS transistor, and if the operating enable signal OP_EN is activated, all of the bits of the first control signal CS1 may be set to have "0" (e.g., a logic low level). In other words, in an operation of controlling or adjusting the first control signal CS1, a priority of the operating enable signal OP_EN may be higher than a priority of the count signal CNT.

When the operating enable signal OP_EN is deactivated (e.g., at time t3 in FIG. 2), the output circuit 144 may generate the first control signal CS1 in response to the count signal CNT again such that at least a part of the plurality of current level controllers is turned on based on the first control signal CS1.

Figure 5:
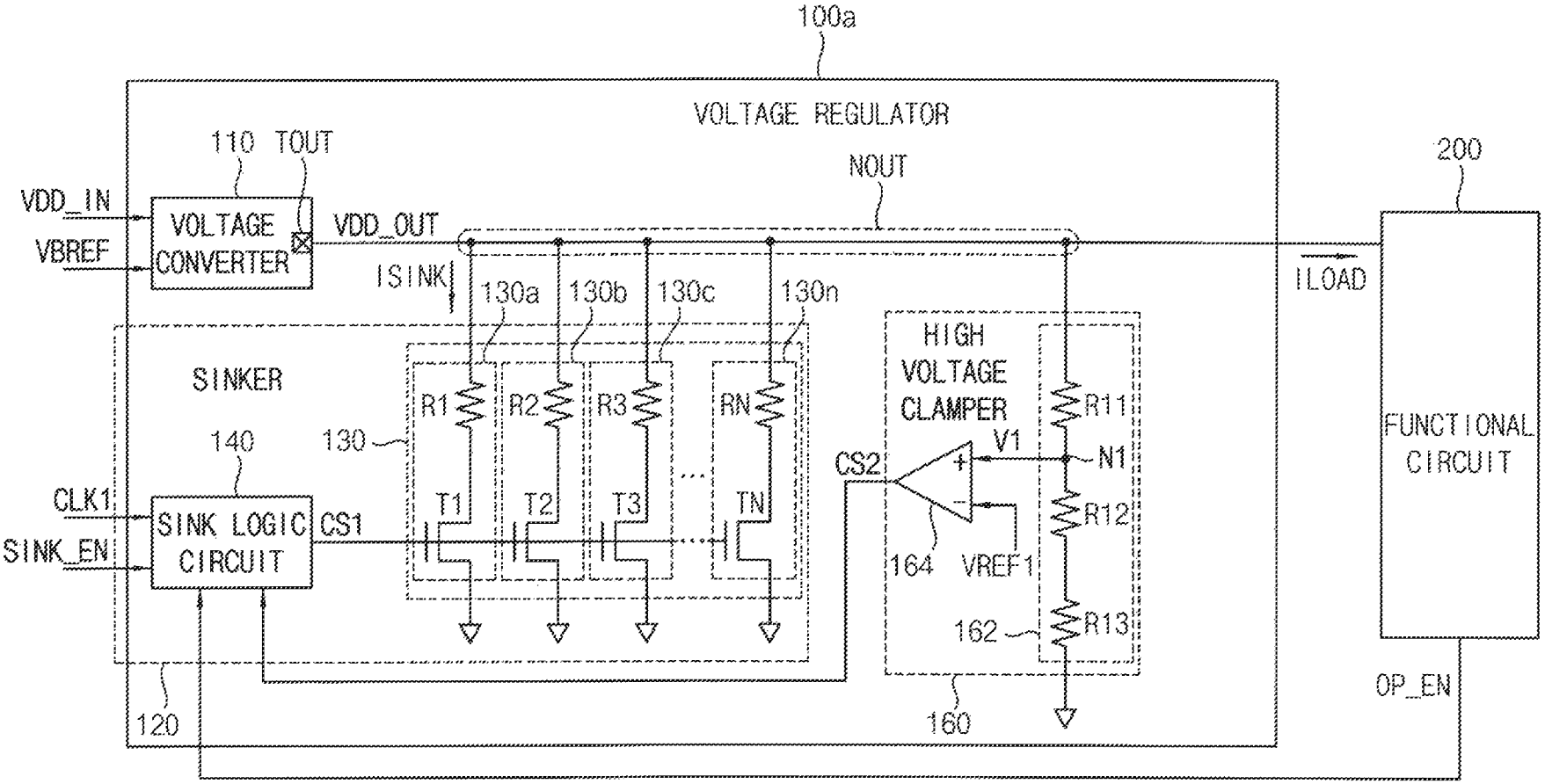
FIG. 5 is a block diagram illustrating a voltage regulator according to at least some example embodiments of the inventive concepts.

FIG. 5 is a block diagram illustrating a voltage regulator according to at least some example embodiments of the inventive concepts.

Referring to FIG. 5, a voltage regulator 100*a* includes a voltage converter 110, a sinker 120 and a high voltage clamper 160.

The voltage regulator 100*a* of FIG. 5 may be substantially the same as the voltage regulator 100 of FIG. 1, except that the voltage regulator 100*a* further includes the high voltage clamper 160. Thus, repeated explanation will be omitted.

The high voltage clamper 160 may be connected to the output terminal TOUT via the output node NOUT. The high voltage clamper 160 may generate a second control signal CS2 that is activated when a level of the output power supply voltage VDD_OUT is higher than a first reference level. The second control signal CS2 may be provided to the sink logic circuit 140 included in the sinker 120, and the sinker 120 may additionally control the generation of the sink current ISINK based on the second control signal CS2.

In some example embodiments, the high voltage clamper 160 may include a first voltage divider 162 and a first comparator 164.

The first voltage divider 162 may be connected between the output terminal TOUT (e.g., the output node NOUT) and the ground voltage, and may generate a first voltage V1 corresponding to the output power supply voltage VDD_OUT.

The first voltage divider 162 may include a plurality of resistors R11, R12 and R13. The resistor R11 may be connected between the output terminal TOUT (e.g., the output node NOUT) and a node N1. The resistors R12 and R13 may be connected in series between the node N1 and the ground voltage. The number and resistances of the resistors R11, R12 and R13 may be changed according to at least some example embodiments of the inventive concepts.

The first comparator 164 may compare the first voltage V1 with a first reference voltage VREF1 to generate the second control signal CS2. The first comparator 164 may include a first input terminal connected to the node N1 and receiving the first voltage V1, a second input terminal receiving the first reference voltage VREF1, and an output terminal outputting the second control signal CS2.

In some example embodiments, the first reference voltage VREF1 may be provided from an outside of the voltage regulator 100*a* (e.g., from an external reference voltage generator). In other example embodiments, although not illustrated in FIG. 5, the high voltage clamper 160 or the voltage regulator 100*a* may include a reference voltage generator that generates the first reference voltage VREF1.

In some example embodiments, the first reference voltage VREF1 and the input reference voltage VBREF may be substantially the same as or different from each other.

Figure 6:
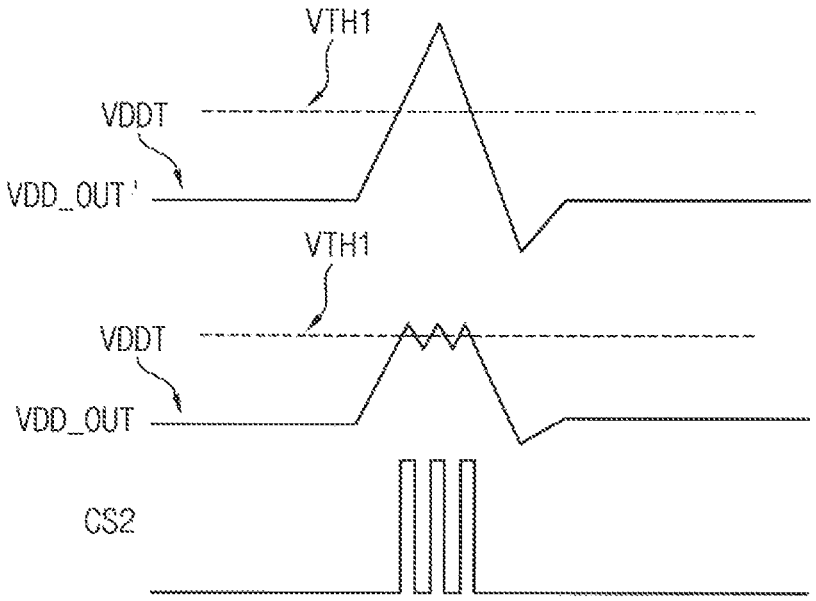
FIG. 6 is a timing diagram for describing an operation of a high voltage clamper that is included in the voltage regulator of FIG. 5.

FIG. 6 is a timing diagram for describing an operation of a high voltage clamper that is included in the voltage regulator of FIG. 5. In FIG. 6, VDD_OUT' represents an output power supply voltage in an example where the high voltage clamper 160 is not included in the voltage regulator, and VDD_OUT represents an output power supply voltage in an example where the high voltage clamper 160 is included in the voltage regulator 100*a* (e.g., in an example of FIG. 5).

Referring to FIGS. 5 and 6, in the example where the high voltage clamper 160 is not included in the voltage regulator, a level of the output power supply voltage VDD_OUT' may be drastically or suddenly changed with respect to the target power level VDDT and may become higher than a first reference level VTH1. In other words, an overshoot may occur on the output power supply voltage VDD_OUT', and the functional circuit 200 may be damaged or broken if the level of the output power supply voltage VDD_OUT' exceeds the upper limit.

In the example where the high voltage clamper 160 is included in the voltage regulator 100*a*, the high voltage clamper 160 may activate the second control signal CS2 when the level of the output power supply voltage VDD_OUT is higher than the first reference level VTH1. While the second control signal CS2 is activated (e.g., while the second control signal CS2 has a logic high level), the sinker 120 may generate the sink current ISINK with the maximum amount to reduce the level of the output power supply voltage VDD_OUT.

When the level of the output power supply voltage VDD_OUT is lower than or equal to the first reference level VTH1, the high voltage clamper 160 may deactivate the second control signal CS2.

Figure 7:
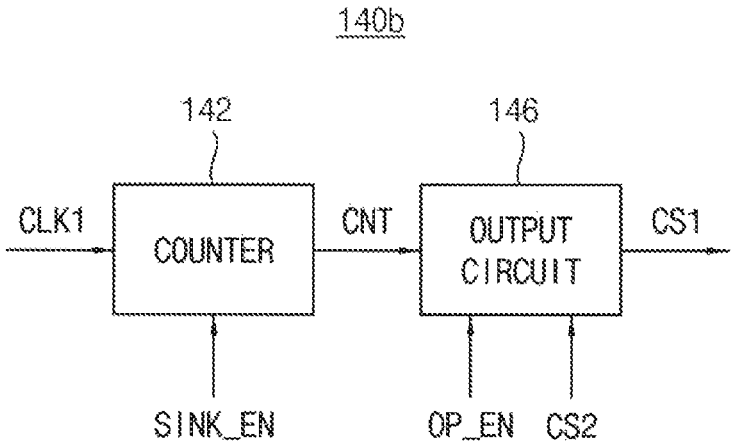
FIG. 7 is a block diagram illustrating an example of a sink logic circuit that is included in the voltage regulator of FIG. 5.

FIG. 7 is a block diagram illustrating an example of a sink logic circuit that is included in the voltage regulator of FIG. 5.

Referring to FIG. 7, a sink logic circuit 140*b* may include a counter 142 and an output circuit 146.

The counter 142 in FIG. 7 may be substantially the same as the counter 142 in FIG. 4, and the output circuit 146 in FIG. 7 may be substantially the same as the output circuit 144 in FIG. 4, except that the output circuit 146 operates further based on the second control signal CS2. Thus, repeated explanation will be omitted.

The output circuit 146 may generate the first control signal CS1 based on the count signal CNT, the operating enable signal OP_EN and the second control signal CS2.

In some example embodiments, the output circuit 146 may generate the first control signal CS1 in response to an activation of the second control signal CS2 such that all of the plurality of current level controllers are turned on (e.g., all of the plurality of current level controllers 130*a*, 130*b*, 130*c*, . . . , 130*n* in FIG. 1 are turned on) based on the first control signal CS1. For example, as described with reference to FIG. 1, the first control signal CS1 may be an N-bit control signal. While the second control signal CS2 is activated (e.g., during a time interval in which the second control signal CS2 has the logic high level in FIG. 6), the output circuit 146 may set the bits of the first control signal CS1 such that all of the current level controllers are turned on based on the first control signal CS1 (e.g., the sink current ISINK is generated with the maximum amount), even if the value of the count signal CNT is not the maximum value or even if the operating enable signal OP_EN is activated. In other words, in an operation of controlling or adjusting the first control signal CS1, a priority of the second control signal CS2 may be higher than the priority of the operating enable signal OP_EN and the priority of the count signal CNT.

While the second control signal CS2 is deactivated (e.g., during a time interval in which the second control signal CS2 has the logic low level in FIG. 6), the output circuit 146 may generate the first control signal CS1 in response to the count signal CNT and the operating enable signal OP_EN again.

Figure 8:
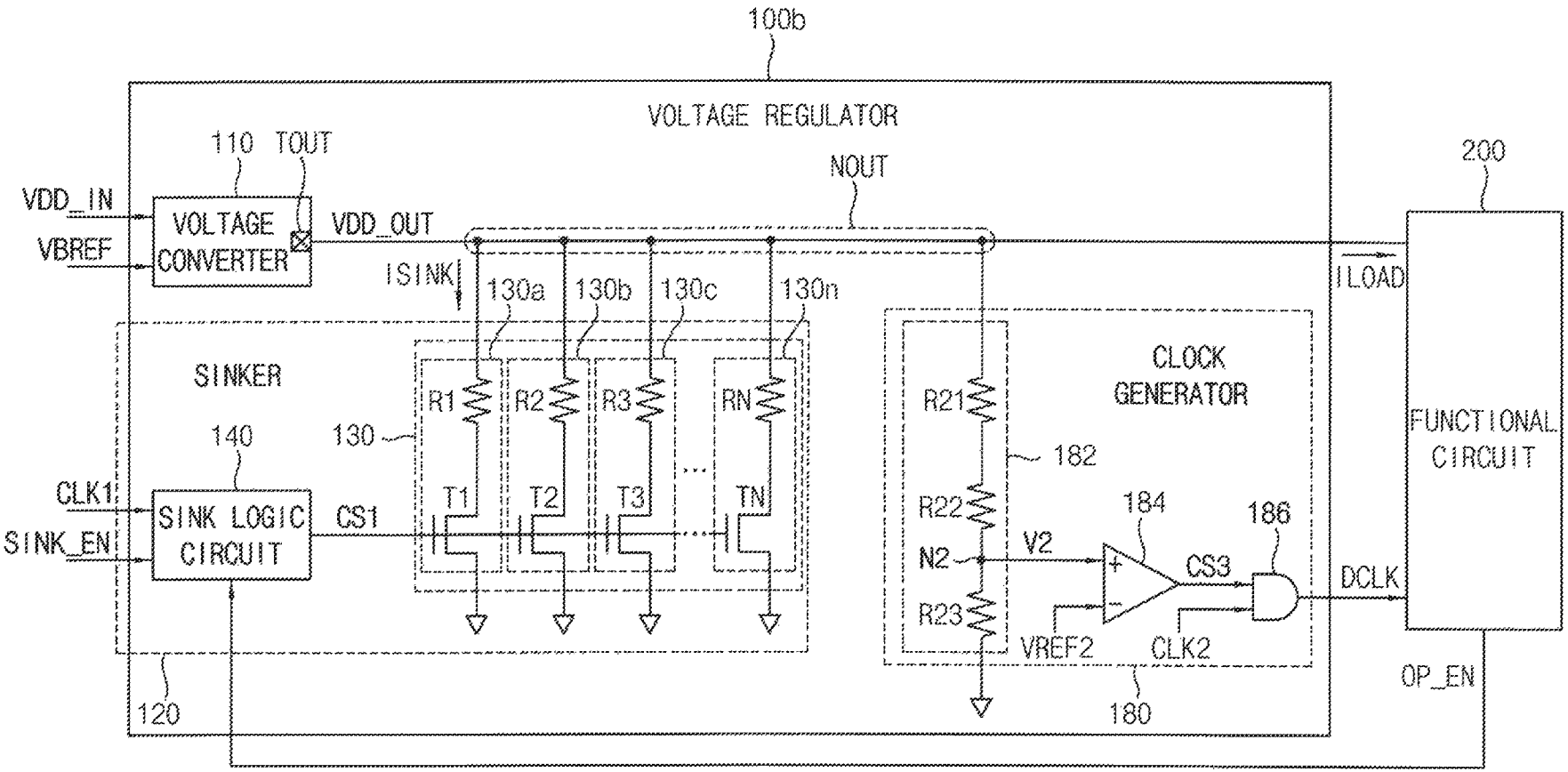
FIG. 8 is a block diagram illustrating a voltage regulator according to at least some example embodiments of the inventive concepts.

FIG. 8 is a block diagram illustrating a voltage regulator according to at least some example embodiments of the inventive concepts.

Referring to FIG. 8, a voltage regulator 100*b* includes a voltage converter 110, a sinker 120 and a clock generator 180.

The voltage regulator 100*b* of FIG. 8 may be substantially the same as the voltage regulator 100 of FIG. 1, except that the voltage regulator 100*b* further includes the clock generator 180. Thus, repeated explanation will be omitted.

The clock generator 180 may be connected to the output terminal TOUT via the output node NOUT. The clock generator 180 may generate a driving clock signal DCLK provided to the functional circuit 200 based on a second clock signal CLK2 and a third control signal CS3 that is activated when a level of the output power supply voltage VDD_OUT is lower than a second reference level. The functional circuit 200 may operate or may be driven based on the output power supply voltage VDD_OUT and the driving clock signal DCLK.

In some example embodiments, the second clock signal CLK2 may be provided from an outside of the voltage regulator 100*b* (e.g., from an external oscillator). In other example embodiments, although not illustrated in FIG. 8, the clock generator 180 or the voltage regulator 100*b* may include an oscillator that generates the second clock signal CLK2.

In some example embodiments, the clock generator 180 may include a second voltage divider 182, a second comparator 184 and an AND gate 186.

The second voltage divider 182 may be connected between the output terminal TOUT (e.g., the output node NOUT) and the ground voltage, and may generate a second voltage V2 corresponding to the output power supply voltage VDD_OUT.

The second voltage divider 182 may include a plurality of resistors R21, R22 and R23. The resistor R21 and R22 may be connected in series between the output terminal TOUT (e.g., the output node NOUT) and a node N2. The resistor R23 may be connected between the node N2 and the ground voltage. The number and resistances of the resistors R21, R22 and R23 may be changed according to at least some example embodiments of the inventive concepts.

The second comparator 184 may compare the second voltage V2 with a second reference voltage VREF2 to generate the third control signal CS3. The second comparator 184 may include a first input terminal connected to the node N2 and receiving the second voltage V2, a second input terminal receiving the second reference voltage VREF2, and an output terminal outputting the third control signal CS3.

In some example embodiments, the second reference voltage VREF2 may be provided from an outside of the voltage regulator 100*b* (e.g., from an external reference voltage generator). In other example embodiments, although not illustrated in FIG. 8, the clock generator 180 or the voltage regulator 100*b* may include a reference voltage generator that generates the second reference voltage VREF2.

The AND gate 186 may generate the driving clock signal DCLK based on the second clock signal CLK2 and the third control signal CS3.

The sink logic circuit 140 in FIG. 8 may be substantially the same as the sink logic circuit 140*a* of FIG. 4.

In some example embodiments, the second reference voltage VREF2 and the input reference voltage VBREF (or the first reference voltage VREF1 in FIG. 5) may be substantially the same as or different from each other. In some example embodiments, the second clock signal CLK2 and the first clock signal CLK1 may be substantially the same as or different from each other.

Figure 9:
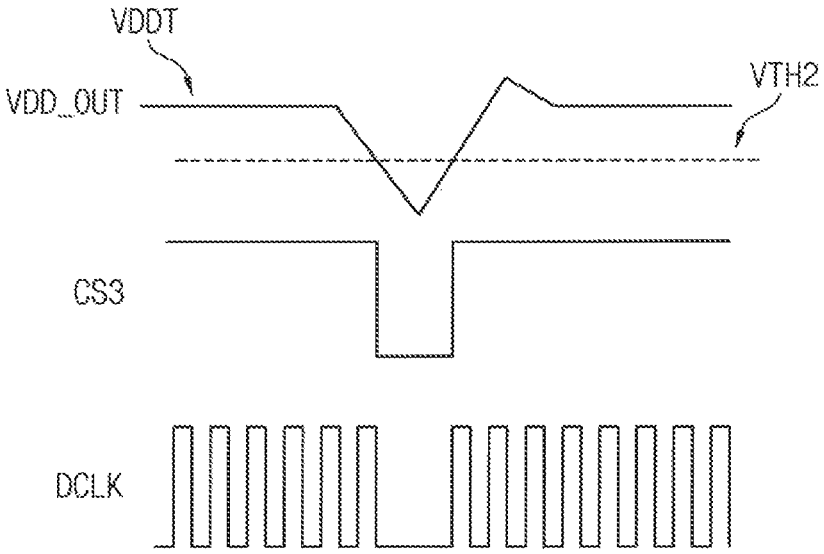
FIG. 9 is a timing diagram for describing an operation of a clock generator that is included in the voltage regulator of FIG. 8.

FIG. 9 is a timing diagram for describing an operation of a clock generator that is included in the voltage regulator of FIG. 8.

Referring to FIGS. 8 and 9, the level of the output power supply voltage VDD_OUT may be drastically or suddenly changed with respect to the target power level VDDT and may become lower than a second reference level VTH2. In other words, an undershoot may occur on the output power supply voltage VDD_OUT, and a malfunction of the functional circuit 200 may be caused if the level of the output power supply voltage VDD_OUT extends beyond the lower limit. According to at least some example embodiments of the inventive concepts, the second reference level VTH2 may be different from the first reference level VTH1 in FIG. 6.

The clock generator 180 may activate the third control signal CS3 when the level of the output power supply voltage VDD_OUT is lower than the second reference level VTH2. While the third control signal CS3 is activated (e.g., while the third control signal CS3 has a logic low level), the clock generator 180 may block generation of the driving clock signal DCLK. For example, the AND gate 186 may perform an AND operation on the second clock signal CLK2 and the third control signal CS3 to generate the driving clock signal DCLK. Since the third control signal CS3 has the logic low level, the driving clock signal DCLK output from the AND gate 186 may have a logic low level based on the logic low level of the third control signal CS3, regardless a level of the second clock signal CLK2. In other words, the clock generator 180 may perform a clock pause function to prevent the driving clock signal DCLK from toggling, and the functional circuit 200 may not operate or may not be driven while the generation of the driving clock signal DCLK is block.

When the level of the output power supply voltage VDD_OUT is higher than or equal to the second reference level VTH2, the clock generator 180 may deactivate the third control signal CS3 and may generate the driving clock signal DCLK again.

Figure 10:
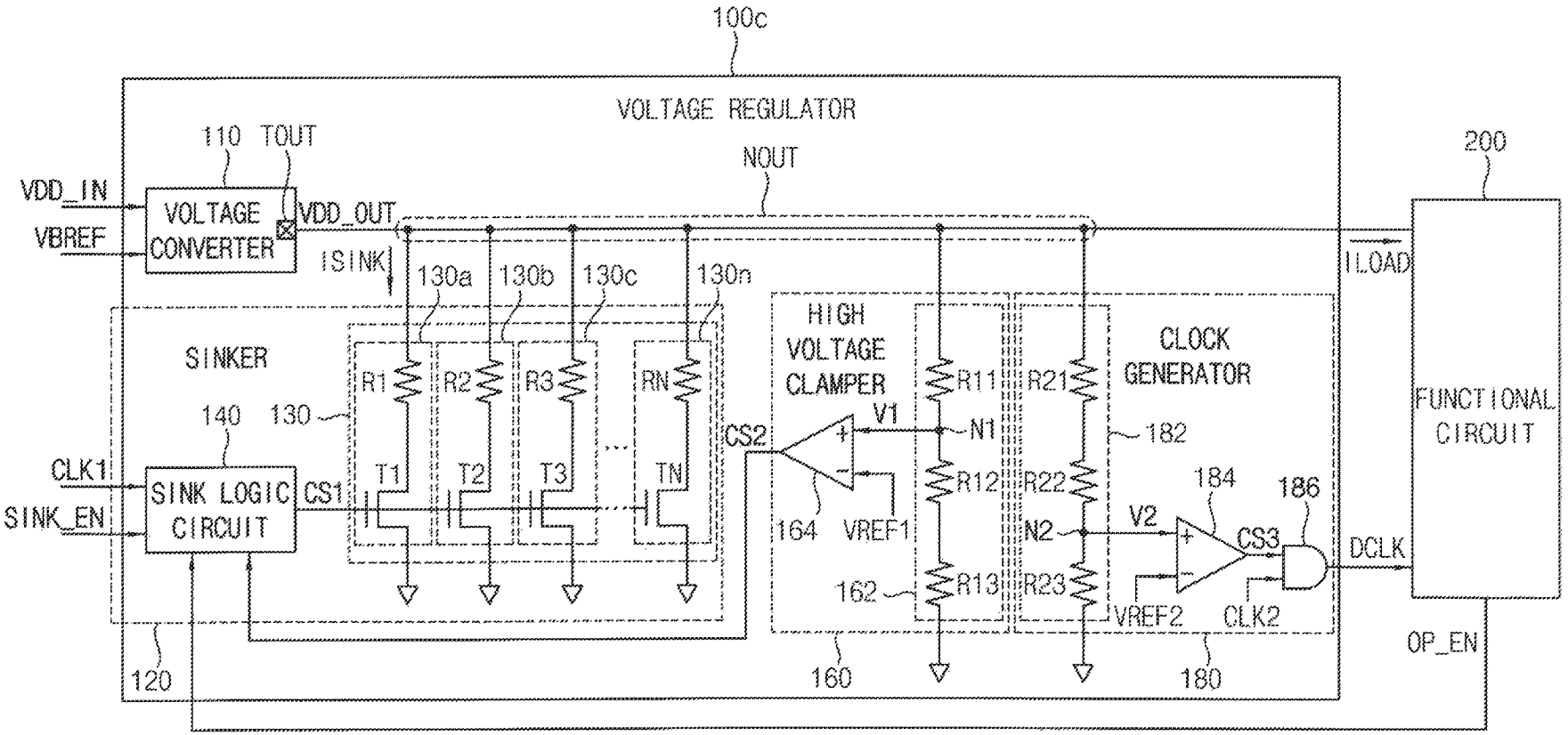
FIG. 10 is a block diagram illustrating a voltage regulator according to at least some example embodiments of the inventive concepts.

FIG. 10 is a block diagram illustrating a voltage regulator according to at least some example embodiments of the inventive concepts.

Referring to FIG. 10, a voltage regulator 100*c* includes a voltage converter 110, a sinker 120, a high voltage clamper 160 and a clock generator 180.

The voltage regulator 100*c* of FIG. 10 may be substantially the same as the voltage regulator 100 of FIG. 1, except that the voltage regulator 100*c* further includes the high voltage clamper 160 and the clock generator 180. The high voltage clamper 160 and the clock generator 180 in FIG. 10 may be substantially the same as the high voltage clamper 160 in FIG. 5 and the clock generator 180 in FIG. 8, respectively. Thus, repeated explanation will be omitted.

The sink logic circuit 140 in FIG. 10 may be substantially the same as the sink logic circuit 140*b* of FIG. 7.

The voltage regulators 100*a*, 100*b* and 100*c* according to at least some example embodiments of the inventive concepts may be implemented as a capacitor-less or a capless voltage regulator, may include the sinker 120, and may further include at least one of the high voltage clamper 160 and the clock generator 180. The overshoot and undershoot on the output power supply voltage VDD_OUT may be prevented by the high voltage clamper 160 and the clock generator 180. Accordingly, the output power supply voltage VDD_OUT having a relatively stable level may be generated.

FIG. 11 is a block diagram illustrating a semiconductor device according to at least some example embodiments of the inventive concepts.

Referring to FIG. 11, a semiconductor device 10 includes a voltage regulator 100, a functional circuit 200 and a controller 50.

The voltage regulator 100 and the functional circuit 200 in FIG. 11 may be substantially the same as the voltage regulator 100 and the functional circuit 200 in FIG. 1, respectively. Thus, repeated explanation will be omitted.

The controller 50 controls the functional circuit 200 and the voltage regulator 100. For example, the controller 50 may generate a control signal CONT for controlling an operation of the functional circuit 200, and may generate the first clock signal CLK1, the sink enable signal SINK_EN and the operating enable signal OP_EN for controlling an operation of the voltage regulator 100. Although not illustrated in FIG. 11, the controller 50 may further generate a driving clock signal provided to the functional circuit 200.

Although FIG. 11 illustrates an example where the operating enable signal OP_EN is provided from the controller 50, according to at least some example embodiments, the operating enable signal OP_EN illustrated in FIG. 11 may be provided to the sink logic circuit 140 from the functional circuit 200 instead of the controller 50, as illustrated in FIG. 1.

In some example embodiments, the voltage regulator 100 in FIG. 11 may be replaced with one of the voltage regulators 100*a*, 100*b* and 100*c* of FIGS. 5, 8 and 10. In this example, the controller 50 may further generate the second clock signal CLK2 in FIGS. 8 and 10.

According to at least some example embodiments of the inventive concepts, the controller 50 may include or be implemented by one or more circuits or circuitry (e.g., hardware) specifically structured to carry out and/or control some or all of the operations described in the present disclosure as being performed by the controller 50; a memory and one or more processors executing computer-readable code (e.g., software and/or firmware) that is stored in the memory and includes instructions for causing the one or more processors to carry out and/or control some or all of the operations described in the present disclosure as being performed by the controller 50; or a combination of the above-referenced hardware and one or more processors executing computer-readable code.

Although not illustrated in FIG. 11, the semiconductor device 10 may further include a voltage generator that generates at least one of voltages (e.g., the input power supply voltage VDD_IN, the input reference voltage VBREF, the first reference voltage VREF1, the second reference voltage VREF2, etc.) provided to the voltage regulator 100.

Figure 12:
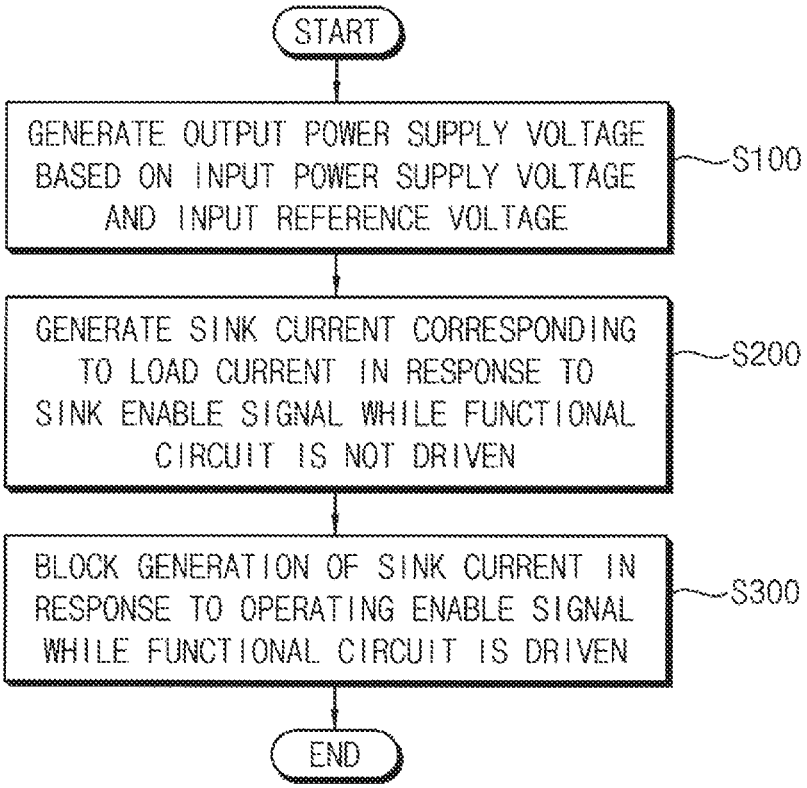
FIGS. 12, 13 and 14 are flow charts illustrating a method of generating a power supply voltage according to at least some example embodiments of the inventive concepts.
Figure 13:
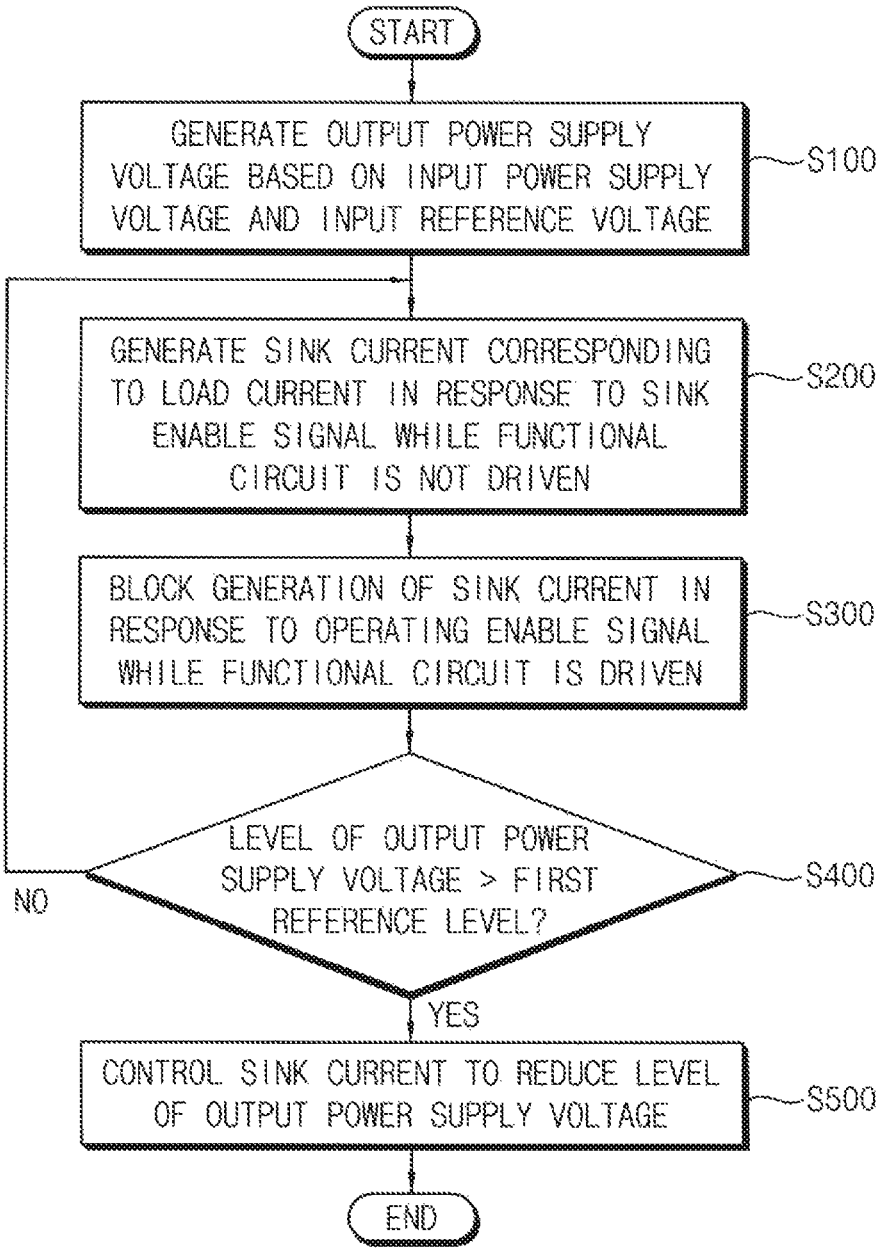
Figure 14:
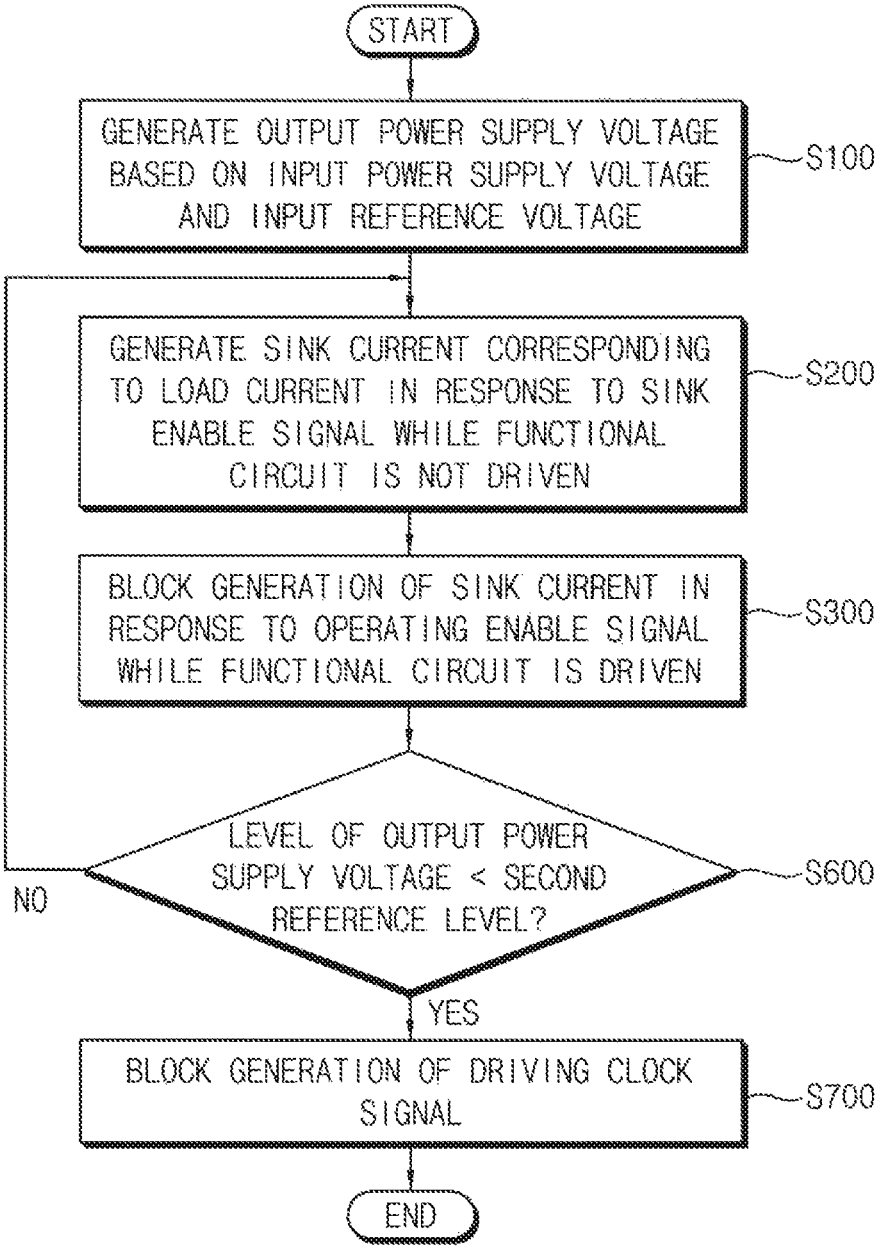

FIGS. 12, 13 and 14 are flow charts illustrating a method of generating a power supply voltage according to at least some example embodiments of the inventive concepts.

Referring to FIGS. 1, 2 and 12, in a method of generating (or stabilizing) a power supply voltage according to at least some example embodiments of the inventive concepts, the voltage converter 110 included in the voltage regulator 100 generates the output power supply voltage VDD_OUT based on the input power supply voltage VDD_IN and the input reference voltage VBREF (step S100).

While the functional circuit 200 is not driven, the sinker 120 generates the sink current ISINK in response to the sink enable signal SINK_EN (step S200). The sink current ISINK corresponds to the load current ILOAD that is to be consumed while the functional circuit 200 is driven. For example, as illustrated in FIG. 2 (e.g., at time t1), the sinker 120 may be enabled in advance in response to the activation of the sink enable signal SINK_EN before the functional circuit 200 is actually driven, and the sink current ISINK corresponding to the load current ILOAD may be scalariformly generated.

While the functional circuit 200 is driven, the sinker 120 blocks the generation of the sink current ISINK in response to the operating enable signal OP_EN (step S300). For example, as illustrated in FIG. 2 (e.g., at time t2), the sinker 120 may be disabled in response to the activation of the operating enable signal OP_EN when the functional circuit 200 is actually driven and the load current ILOAD is actually consumed by the functional circuit 200, and the generation of the sink current ISINK may be blocked.

After then, when the functional circuit 200 is not driven again, the sinker 120 may generate the sink current ISINK again in response to the deactivation of the operating enable signal OP_EN (e.g., at time t3 in FIG. 2). In addition, when it does not need to operate or be driven the functional circuit 200 anymore, the sinker 120 may scalariformly block the generation of the sink current ISINK in response to the deactivation of the sink enable signal SINK_EN (e.g., at time t6 in FIG. 2).

Referring to FIGS. 5, 6 and 13, steps S100, S200 and S300 in FIG. 13 may be substantially the same as steps S100, S200 and S300 in FIG. 12, respectively. Thus, repeated explanation will be omitted.

When the level of the output power supply voltage VDD_OUT is higher than the first reference level VTH1 (step S400: YES), the high voltage clamper 160 may activate the second control signal CS2. While the second control signal CS2 is activated, the sinker 120 may control or adjust the sink current ISINK to reduce the level of the output power supply voltage VDD_OUT (step S500). For example, the sinker 120 may generate the sink current ISINK with the maximum amount in response to the activated second control signal CS2.

When the level of the output power supply voltage VDD_OUT is lower than or equal to the first reference level VTH1 (step S400: NO), steps S200 and S300 may be repeated.

Referring to FIGS. 8, 9 and 14, steps S100, S200 and S300 in FIG. 14 may be substantially the same as steps S100, S200 and S300 in FIG. 12, respectively. Thus, repeated explanation will be omitted.

When the level of the output power supply voltage VDD_OUT is lower than the second reference level VTH2 (step S600: YES), the clock generator 180 may activate the third control signal CS3. While the third control signal CS3 is activated, the clock generator 180 may block generation of the driving clock signal DCLK (step S700). For example, the clock generator 180 may prevent the driving clock signal DCLK from toggling in response to the activated third control signal CS3.

When the level of the output power supply voltage VDD_OUT is higher than or equal to the second reference level VTH2 (step S600: NO), steps S200 and S300 may be repeated.

In some example embodiments, the method of generating the power supply voltage may be implemented with all of steps S100, S200, S300, S400, S500, S600 and S700.

In some example embodiments, at least a part of the method of generating the power supply voltage may be implemented as hardware. In other example embodiments, at least a part of the method of generating the power supply voltage may be implemented as instructions or program routines (e.g., a software program). For example, the instructions or the program routines may be executed by a processor (not illustrated), and may be stored in a memory or storage (not illustrated).

The present disclosure may be used in various kinds of voltage regulators, or a device or a system including the voltage regulators, such as a personal computer, a laptop computer, a mobile phone, a smart phone, a tablet computer, a personal digital assistants (PDA), an enterprise digital assistant (EDA), a portable multimedia player (PMP), a digital camera, a music player, a portable game console, a navigation device, a wearable device, an internet of things (IoT) device, an internet of everything (IoE) device, an e-book, a virtual reality (VR) device, an augmented reality (AR) device, etc.

The voltage regulator according to at least some example embodiments of the inventive concepts may be implemented as a capacitor-less or a capless voltage regulator in which an external capacitor or an output capacitor connected to the output terminal is not used, and may include the sinker for stabilizing the output power supply voltage. The sinker may be enabled in advance before the functional circuit actually operates or is driven, and may scalariformly generate the sink current corresponding to the load current that is predicted to be consumed while the functional circuit is actually driven. When the functional circuit is enabled and actually operates or is driven, and when the load current is actually consumed by the functional circuit, the sinker may block the generation of the sink current. Accordingly, the amount of total current flowing through the output terminal may not be substantially changed and may be substantially maintained, the level change of the output power supply voltage may be minimized or reduced, and the output power supply voltage having a relatively stable level may be generated.

In addition, the voltage regulator according to at least some example embodiments of the inventive concepts may further include at least one of the high voltage clamper and the clock generator. The overshoot and undershoot on the output power supply voltage may be prevented by the high voltage clamper and the clock generator. Accordingly, the output power supply voltage having a relatively stable level may be generated.

Example embodiments of the inventive concepts having thus been described, it will be obvious that the same may be varied in many ways. Such variations are not to be regarded as a departure from the intended spirit and scope of example embodiments of the inventive concepts, and all such modifications as would be obvious to one skilled in the art are intended to be included within the scope of the following claims.

What is claimed is:

1. A voltage regulator comprising:

a voltage converter configured to generate an output power supply voltage based on an input power supply voltage and an input reference voltage and provide the output power supply voltage to an external functional circuit, the voltage converter including an output terminal configured to output the output power supply voltage; and a sinker connected to the output terminal, the sinker configured to generate a sink current in response to a sink enable signal while the external functional circuit is not driven and configured to block generation of the sink current in response to an operating enable signal while the external functional circuit is driven, wherein the sink current corresponds to a load current that is to be consumed while the external functional circuit is driven.

2. The voltage regulator of claim 1, wherein the sinker is configured such that a level of the sink current increases stepwise from a zero level to a target level in response to an activation of the sink enable signal, and wherein the zero level represents non-generation of the sink current, and the target level corresponds to the load current.

3. The voltage regulator of claim 2, wherein the sinker is configured such that the level of the sink current decreases stepwise from the target level to the zero level in response to a deactivation of the sink enable signal.

4. The voltage regulator of claim 1, wherein the sinker is configured such that a level of the sink current, increases stepwise from a zero level to a target level in response to an activation of the sink enable signal, and instantaneously decreases from the target level to the zero level in response to an activation of the operating enable signal, and wherein the zero level represents non-generation of the sink current, and the target level corresponds to the load current.

5. The voltage regulator of claim 4, wherein the sinker is configured such that the level of the sink current, instantaneously increases from the zero level to the target level in response to a deactivation of the operating enable signal, and decreases stepwise from the target level to the zero level in response to a deactivation of the sink enable signal.

6. The voltage regulator of claim 1, wherein the sinker comprises:

a current generator connected to the output terminal, the current generator configured to generate the sink current in response to a first control signal; and a sink logic circuit configured to generate the first control signal based on the sink enable signal and the operating enable signal.

7. The voltage regulator of claim 6, wherein the current generator comprises:

a plurality of current level controllers connected in parallel between the output terminal and a ground voltage, the plurality of current level controllers configured to be selectively turned on in response to the first control signal, and wherein each of the plurality of current level controllers comprises:

a resistor connected to the output terminal; and a transistor connected between the resistor and the ground voltage, the transistor having a control electrode receiving the first control signal.

8. The voltage regulator of claim 7, wherein the sink logic circuit comprises:

a counter configured to generate a count signal that sequentially increases or decreases based on a first clock signal and the sink enable signal; and an output circuit configured to generate the first control signal based on the count signal and the operating enable signal.

9. The voltage regulator of claim 8, wherein the counter is configured to, sequentially increase a value of the count signal in response to the first clock signal and an activation of the sink enable signal, and sequentially decrease the value of the count signal in response to the first clock signal and a deactivation of the sink enable signal.

10. The voltage regulator of claim 8, wherein the output circuit is configured to, generate the first control signal in response to the count signal such that at least a part of the plurality of current level controllers is turned on, and generate the first control signal in response to an activation of the operating enable signal such that all of the plurality of current level controllers are turned off.

11. The voltage regulator of claim 1, further comprising:

a high voltage clamper connected to the output terminal, the high voltage clamper configured to generate a control signal that is activated when a level of the output power supply voltage is higher than a reference level, wherein the sinker is configured to additionally control the generation of the sink current based on the control signal.

12. The voltage regulator of claim 11, wherein, while the control signal is activated, the sinker is configured to generate the sink current to decrease the level of the output power supply voltage.

13. The voltage regulator of claim 11, wherein the high voltage clamper includes:

a voltage divider connected between the output terminal and a ground voltage; and a comparator configured to compare a first voltage with a first reference voltage to generate the control signal, the first voltage being generated by the voltage divider and corresponding to the output power supply voltage.

14. The voltage regulator of claim 1, further comprising:

a clock generator connected to the output terminal, the clock generator configured to generate a driving clock signal provided to the external functional circuit based on a first clock signal and a control signal that is activated when a level of the output power supply voltage is lower than a reference level.

15. The voltage regulator of claim 14, wherein, the clock generator is configured such that, while the control signal is activated, the clock generator blocks generation of the driving clock signal.

16. The voltage regulator of claim 14, wherein the clock generator comprises:

a voltage divider connected between the output terminal and a ground voltage;

a comparator configured to compare a first voltage with a reference voltage to generate the control signal, the first voltage being generated from the voltage divider and corresponding to the output power supply voltage; and an AND gate configured to generate the driving clock signal based on the first clock signal and the control signal.

17. The voltage regulator of claim 1, wherein the sinker is configured such that an amount of the sink current is substantially the same as an amount of the load current.

18. A semiconductor device comprising:

a functional circuit configured to operate based on an output power supply voltage;

a voltage regulator configured to, generate the output power supply voltage based on an input power supply voltage and an input reference voltage, generate a sink current in response to a sink enable signal while the functional circuit is not driven, and block generation of the sink current in response to an operating enable signal while the functional circuit is driven; and a controller configured to control the functional circuit and the voltage regulator, wherein the sink current corresponds to a load current that is to be consumed while the functional circuit is driven.

19. The semiconductor device of claim 18, wherein the controller is configured to generate the sink enable signal, and wherein the controller is configured to generate the operating enable signal or the functional circuit is configured to generate the operating enable signal.

20. A method of generating a power supply voltage, the method comprising:

generating an output power supply voltage based on an input power supply voltage and an input reference voltage and providing the output power supply voltage to an external functional circuit;

generating a sink current in response to a sink enable signal while the external functional circuit is not driven; and blocking generation of the sink current in response to an operating enable signal while the external functional circuit is driven, wherein the sink current corresponds to a load current that is to be consumed while the external functional circuit is driven.

* * * * *